US012698932B2

(12) United States Patent
Trümper et al.

(10) Patent No.: US 12,698,932 B2
(45) Date of Patent: Aug. 4, 2026

(54) THERMAL CONTROL SYSTEM FOR THERMAL SENSITIVE FREIGHT TRANSPORTATION AND TRANSPORT CONTAINER AND AIRCRAFT HAVING THE SAME

(71) Applicant: Airbus Operations GmbH, Hamburg (DE)

(72) Inventors: Torsten Trümper, Hamburg (DE); Lucas Beyer, Hamburg (DE)

(73) Assignee: Airbus Operations GmbH, Hamburg (DE)

( * ) Notice: Subject to any disclaimer, the term of this patent is extended or adjusted under 35 U.S.C. 154(b) by 105 days.

(21) Appl. No.: 18/619,403

(22) Filed: Mar. 28, 2024

(65) Prior Publication Data

US 2024/0328698 A1 Oct. 3, 2024

(30) Foreign Application Priority Data

Mar. 31, 2023 (EP) ..... 23166184

(51) Int. Cl.
*F25D 11/00* (2006.01)
*F25D 29/00* (2006.01)

(52) U.S. Cl.
CPC ..... *F25D 11/003* (2013.01); *F25D 29/00* (2013.01); *F25D 2303/085* (2013.01); *F25D 2600/04* (2013.01)

(58) Field of Classification Search
CPC ..... F25D 23/069; F25D 11/02; F25D 11/006; F25D 3/12; F25D 2303/0831; F25D 2303/083; B65D 81/382
See application file for complete search history.

(56) References Cited

U.S. PATENT DOCUMENTS 2,499,736 A 3/1950 Kleen
3,971,231 A * 7/1976 Derry ..... F25D 3/12 62/449
6,141,982 A * 11/2000 Schwarz ..... F25D 3/06 62/201
9,303,912 B1 4/2016 Schalla et al.
12,140,367 B2 * 11/2024 Lazar ..... F25D 17/045
(Continued)

FOREIGN PATENT DOCUMENTS

EP 3633304 B1 12/2020
WO 2022263840 A1 12/2022

OTHER PUBLICATIONS

European Search Report for corresponding European Application No. 23166184 dated Sep. 5, 2023.

*Primary Examiner* — Nelson J Nieves
(74) *Attorney, Agent, or Firm* — Greer, Burns & Crain, Ltd.

(57) ABSTRACT

A thermal control system and transport container with a thermal control system for transporting a payload. The thermal control system comprises a case, and an intermediate floor dividing an interior space of the case in a first section and a second section. The thermal control system further comprises a first air passage arranged in the case and fluidly connecting the first section with an exterior environment of the case. The intermediate floor comprises a phase-change material and is configured to allow air to pass through the intermediate floor and to exchange heat with the phase-change material.

16 Claims, 4 Drawing Sheets

(56) References Cited

U.S. PATENT DOCUMENTS

| | | | | |
|---|---|---|---|---|
| 2008/0276840 | A1* | 11/2008 | Van Loon | A47B 31/00 49/503 |
| 2017/0131015 | A1 | 5/2017 | Farrar | |
| 2021/0053725 | A1* | 2/2021 | Barfoot | B65D 25/06 |

* cited by examiner

THERMAL CONTROL SYSTEM FOR THERMAL SENSITIVE FREIGHT TRANSPORTATION AND TRANSPORT CONTAINER AND AIRCRAFT HAVING THE SAME

CROSS-REFERENCES TO RELATED APPLICATIONS

This application claims the benefit of European Patent Application Number 23 166 184.4 filed on Mar. 31, 2023, the entire disclosure of which is incorporated herein by way of reference.

FIELD OF THE INVENTION

The present disclosure generally relates to a thermal control system for transporting a thermal sensitive payload as well as a transport system and aircraft comprising such thermal control system. Particularly, the present disclosure relates to a thermal control system comprising a case and a floor dividing the interior space of the case in two sections, wherein the floor has a phase-change material and allows air to pass therethrough. Further disclosed are a transport system and an aircraft having such thermal control system.

BACKGROUND OF THE INVENTION

A conventional thermal control system used to transport thermal sensitive freight is a stand-alone system that uses electric power to maintain a certain climate, particularly temperature, suitable for the payload in the system. The electric power can, for example, be supplied by the transporting vehicle, such as an aircraft. In order to be allowed in an aircraft, any system requires certification. Thus, a thermal control system using electric power from the aircraft has to undergo certification processes each time changes are made to the system.

Moreover, the thermal control system depends on the availability of electric power in the aircraft (e.g., the cargo space) and usually requires a continuous power supply during the entire transportation phase. Thus, any power outage may harm the payload.

SUMMARY OF THE INVENTION

It is therefore an object of the present disclosure to provide a thermal control system and transport system having a reduced complexity and provides for a plurality of applications of the system.

This object may be achieved by one or more embodiments of the present invention described herein.

According to a first aspect to better understand the present disclosure, a thermal control system for transporting a payload comprises a case, and an intermediate floor dividing an interior space of the case in a first section and a second section. Furthermore, the thermal control system comprises a first air passage arranged in the case and fluidly connecting the first section with an exterior environment of the case, wherein the intermediate floor comprises a phase-change material and is configured to allow air to pass through the intermediate floor and to exchange heat with the phase-change material.

Thus, the thermal control system can operate without any electric power supply, so that there is no wiring needed and no active and mechanical or movable parts are required.

Therefore, complexity of the system is significantly reduced, which further decreases development, certification and maintenance costs.

Heat stored in the phase-change material can simply be provided by an air stream through the intermediate floor into the second section. In other words, the intermediate floor forms a heat exchanger dividing the interior space of the case in the first and second sections.

In an implementation variant, the first air passage can be configured to allow air from the exterior environment to enter into the first section. Thus, an air stream beginning at the exterior environment and flowing through the first air passage is possible. As a mere example, the first air passage can be configured to hinder or block air from leaving the first section through the first air passage. This can be achieved by, for example, one or more valves, a membrane, a flap or a similar one-way air passage.

In a further implementation variant, the first air passage can be configured to allow bidirectional air flow into and out of the first section. Such airflow may be induced by, for example, pressure changes in the exterior environment, while a pressure equalization between the exterior environment and the interior space of the case can take place through the first air passage.

Since the intermediate floor is configured to allow air to pass through, the pressure equalization will likewise take place between the second section and the exterior environment, but through the first section and through the intermediate floor. Thus, no ventilation device is required to convey air through the intermediate floor.

In a further implementation variant, the thermal control system can further comprise a second air passage arranged in the case and fluidly connecting the second section with the exterior environment of the case. Thus, air streaming through the intermediate floor into the second section may further flow through the second air passage to the exterior environment. Thereby, heat stored by the phase-change material can be transferred to the air entering the second section and further flowing through the second air passage. The heated or warmed air can then be used at a place in the exterior environment and close to the second air passage.

It is to be understood that an air duct (pipe) can be coupled to the second air passage, in order to duct the heated or warmed air to the required site.

In yet a further implementation variant, the second air passage can be configured to allow air to leave the second section into the exterior environment. As a mere example, the second air passage can be configured to hinder or block air from entering the second section through the second air passage (e.g., coming from the exterior environment). Thus, it is assured that an air stream coming through the intermediate floor into the second section leaves through the second air passage. Any item arranged close to or in fluid communication with the second air passage is, hence, provided with air heated by the phase-change material in the intermediate floor.

In a further implementation variant, the intermediate floor can comprise a port configured to release the phase-change material from the intermediate floor and/or to fill the phase-change material into the intermediate floor. For instance, a valve and/or inlet/outlet may be arranged in the intermediate floor, in order to release the phase-change material and replace it with another phase-change material, i.e., (re) fill the intermediate floor with the phase-change material. Thus, an exchange or replacement of phase-change material is possible.

This allows to adapt a heat capacity of the heat exchange functionality of the intermediate floor. For instance, the phase-change materials may have different phase-change temperatures, so that the intermediate floor and particularly, the thermal control system can be adjusted and adapted to the payload, particularly the allowable air temperature for transporting the payload.

In yet a further implementation variant, the case can be configured to releasably hold the intermediate floor, so that the intermediate floor can be replaced. As a mere example, the case can have one or more protrusions and/or recesses, which are configured to hold the intermediate floor (e.g., the intermediate floor rests on the protrusion(s), is inserted into the recess(s) and/or has a groove or gap sliding over the protrusion(s).

Furthermore, the case can have a door or flap in an area of the intermediate floor, so that the intermediate floor can be removed from the case and be inserted into the case through the door or flap opening.

In any case, the intermediate floor can be replaced in a fast manner. For instance, a heated intermediate floor (the phase-change material stores heat energy, for example, by being in a fluid state) can be placed in the case, and after use the (cooled) intermediate floor is removed and can be replaced by a heated intermediate floor.

In another implementation variant, the phase-change material has a phase-change temperature between −40° C. and +40° C., preferably between −30° C. and +30° C., and most preferably of approximately 22° C. Thus, if air streaming through the intermediate floor has a temperature below the phase-change temperature, for example, the freezing temperature of the phase-change material, the phase-change material will start freezing (changing its phase). This releases heat from the phase-change material into the air stream, so that the air in the second section is warmer than the air in the first section. It is to be understood, that if a second air passage is present, the air leaving the second section after streaming through the intermediate floor is warmer than the air entering the first section.

In yet another implementation variant, the phase-change material is a paraffin, lipid, sugar alcohol, or the like. It is to be understood that any material can be used. The phase-change material should be selected, in order to have a phase-change temperature above a temperature of the air entering the first section and streaming through the intermediate floor. This ensures that the entering air stream is warmed/heated by heat exchange with the phase-change material, which at this time changes its phase, for example, freezes or solidifies.

In any case, the phase-change material can be chosen with respect to the payload to be transported. In other words, the phase-change material can be chosen in accordance with the phase-change temperature of the phase-change material. The phase-change temperature can be selected based on or corresponding to the lowest allowable temperature for the payload.

In a further implementation variant, the intermediate floor can be configured to allow the air to pass therethrough with a velocity of flow between 0.5 m/s and 2.0 m/s, preferably between 0.7 m/s and 1.5 m/s. This can be achieved by providing a plurality of channels in the intermediate floor having a cross-section that allows air to pass through the channels at the desired velocity of flow. Additionally, the baffles and/or deflectors may be arranged at the intermediate floor, that slowdown an air stream. Alternatively or additionally, one or more nozzles may be provided in or at the intermediate floor, that accelerate the air stream.

In yet a further implementation variant, the thermal control system can further comprise a heating element configured to heat air in the first section and/or to heat the phase-change material in the intermediate floor. This allows maintaining the phase-change material in a heat storing state, such as in a fluid state, over a longer transportation time.

In another implementation variant, the case of the thermal control system can be made of an insulating material. Thus, heat losses from the intermediate floor and, particularly, from the phase-change material, can be reduced.

In a further implementation variant, the intermediate floor can be configured to carry the payload arranged in the second section. Thus, the second section forms a transport section for the payload. The second section can be insulated by the case, so that a temperature required for the payload during transportation can be maintained inside the second section. Additionally, air entering the second section through the intermediate floor is heated due to the phase-change material emitting heat energy into the airstream.

According to a second aspect to better understand the present disclosure, a transport system comprises a transport container configured to hold a payload, and a thermal control system according to the first aspect or one of its variants or examples. An interior space of the transport container is fluidly connected with the second section of the thermal control system.

Thus, air streaming from the thermal control system into the interior space of the transport container is warmed/heated by the phase-change material in the intermediate floor. This allows the air entering the transport container to have a temperature that does not harm the payload.

As a mere example, the transport system may be employed in an aircraft, where the exterior environment corresponds to an interior (cargo) area of the aircraft. Such aircraft area is often not pressurized or only pressurized to a small extent (e.g., 500 hPa or less). Thus, during flight the pressure in the exterior environment of the transport system decreases, so that air in the interior space of the transport container escapes. When the aircraft descends, the pressure increases and is about to enter the interior space of the transport container. However, such air is cold (e.g., between 0° C. and minus 30° C., or can even be down to approximately −50° C. depending on the insulation capability of the aircraft and the duration of the flight) as it was cooled by the ambient air around the aircraft at high-altitude, which may harm the payload.

Since the transport system is equipped with the thermal control system, the air entering the interior space of the transport container during the recompression is forced to flow through the intermediate floor and, hence, its temperature is increased by the phase-change material. Thus, the air temperature can fulfil the temperature requirements of the payload.

As a mere example, the payload can be an electronic component or electric/electronic device, such as a satellite, which should not be exposed to low temperatures (below usual room temperature of, for example, 15° C. to 30° C.) and, particularly, should not be exposed to temperature drops. Employing the disclosed thermal control system alleviates the temperature drop and, hence, can avoid any ice development or other harms to the payload due to the low air temperature.

In an implementation variant, the transport system can further comprise an air release passage arranged in the transport container and fluidly connecting the interior space of the transport container with the exterior environment.

Thus, the air inside of the transport container can be released through the air release passage.

In other words, the air release passage can be configured to allow air to leave the interior space of the transport container into the exterior environment. This may allow a pressure equalization from the interior space of the transport container towards the exterior environment.

On the other hand, the air release passage can be configured to hinder or block air to enter the interior space of the transport container from the exterior environment. This allows forcing recompression of the interior space of the transport container to completely take place through the thermal control system of the present disclosure. Thus, it can be ensured that heat from the phase-change material is taken up by the air streaming into the interior space of the transport container during recompression.

In a further implementation variant, the thermal control system can be equipped with the second air passage arranged in the case. In this particular case, the second air passage can fluidly connect the second section with the interior space of the transport container.

As a mere example, the second air passage can be configured to allow air from the second section to enter into the interior space of the transport container. In order to avoid air from the interior space of the transport container to stream through the intermediate floor and, hence, exchange heat with the phase-change material, the second air passage can further be configured to hinder or block air from the interior space of the transport container to enter into the second section. For example, the air in the interior space of the transport container may leave the transport container through the air release passage.

In yet a further implementation variant, the transport container can be insulated. Thus, even if air escapes from the transport container (e.g., during a pressure reduction inside an aircraft during ascending), the temperature of the payload can be maintained over time. For example, a conventional installation can allow a temperature decrease in the interior space of the transport container of about 2 to 3° K (Kelvin) per hour, even at temperatures in the area of the aircraft of about minus 30° C. or minus 50° C.

In another implementation variant, the transport system can further comprise an air conveying device configured to convey air from the interior space of the transport container to the first section of the thermal control system. This allows conveying air through the intermediate floor, so that the phase-change material in the intermediate floor can be used to heat the air inside of the transport container.

Since the air conveying devices does not need to have any heating element, it can be made less complex and will be easier to certify for use in an aircraft.

It is to be understood that the air conveying device can further comprise a heating element, in case maintaining the temperature in the interior space of the transport container is required for a longer time period or for a less insulated transport container.

According to a third aspect to better understand the present disclosure, an aircraft comprises at least one thermal control system according to the first aspect or one of its variants or examples.

Additionally or alternatively, the aircraft can comprise at least one transport system according to the second aspect or one of its variants or examples.

The aircraft may have an area, such as a cargo area, which may not be pressurized. Thus, when reaching a high altitude, the air pressure inside the area is reduced, so that air inside the case of the thermal control system as well as inside the transport container escapes. When the aircraft descends, the pressure in the area increases again, and forces the transport container to recompress. As the air at the high altitude is very cold, the air entering the transport container is also cold and could harm the payload in the transport container.

Since during recompression of the transport container the recompress in air is forced through the thermal control system, particularly through the first air passage, the intermediate floor and the second air passage, the air temperature can be adjusted to be suitable for the payload.

The present disclosure is not restricted to the aspects and variants in the described form and order. Specifically, the description of aspects and variants is not to be understood as a specific limiting grouping of features. It is to be understood that the present disclosure also covers combinations of the aspects and variants. Thus, each variant or optional feature can be combined with any other aspect, variant, optional feature or even combinations thereof.

BRIEF DESCRIPTION OF THE DRAWINGS

In the following, the present disclosure will further be described with reference to exemplary implementations illustrated in the figures, in which.

DETAILED DESCRIPTION OF THE PREFERRED EMBODIMENTS

In the following description, for purposes of explanation and not limitation, specific details are set forth in order to provide a thorough understanding of the present disclosure. It will be apparent to one skilled in the art that the present disclosure may be practiced in other implementations that depart from these specific details.

Figure 1:
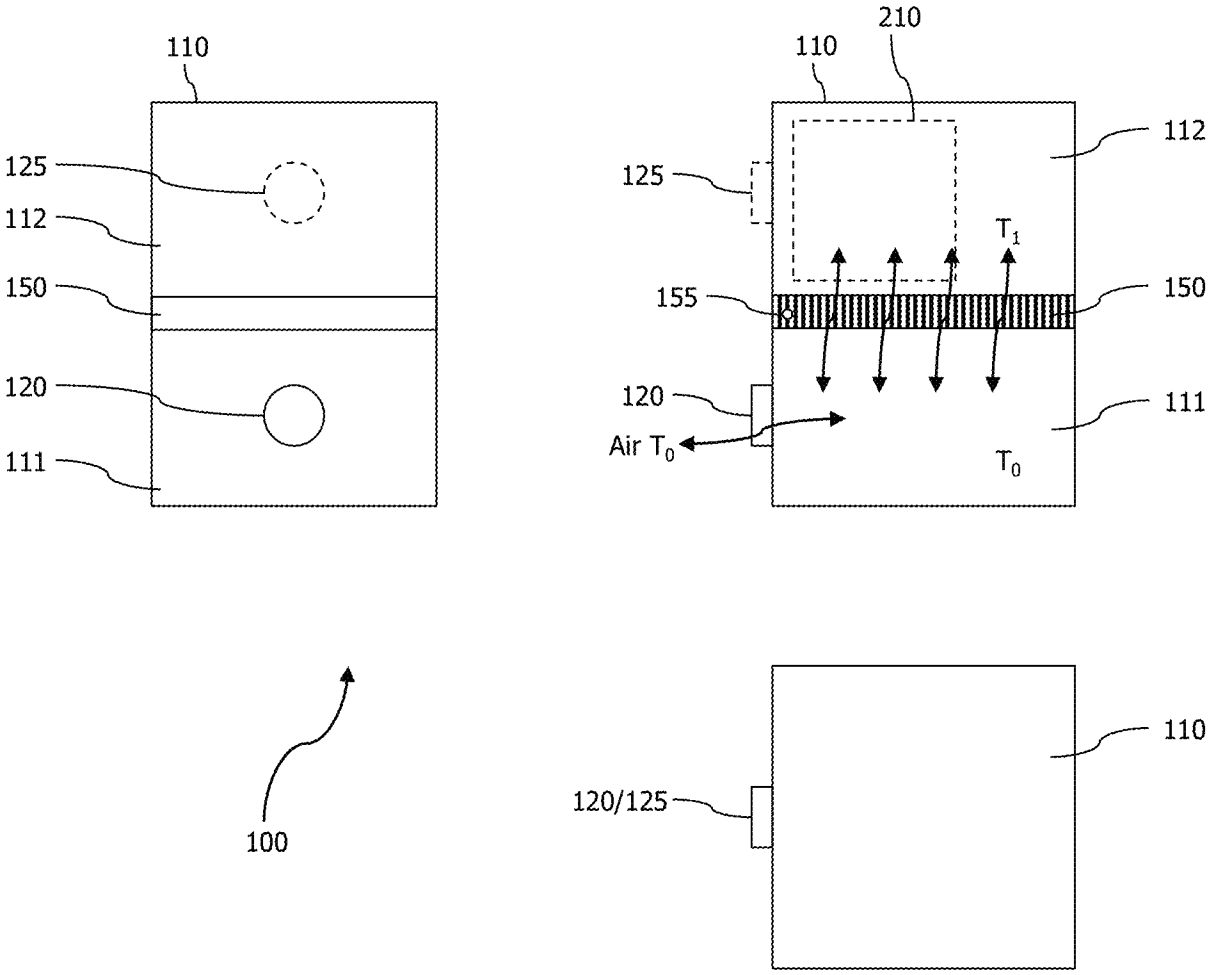
FIG. 1 schematically illustrates an exemplary thermal control system.

FIG. 1 schematically illustrates an exemplary thermal control system 100 in two side views and a plan view (lower portion of FIG. 1).

The exemplary thermal control system 100 comprises a case 110, which can have any form. FIG. 1 illustrates a box-shaped case 110 which is just one exemplary shape or the case 110. The case 110 can be an insulating case, so that it thermally insulates an interior space of the case 110 from an exterior environment around the case 110.

The thermal control system 100 further comprises an intermediate floor 150 dividing the interior space of the case 110 in a first section 111 and a second section 112. The size of the first and second sections 111, 112 can be arbitrarily chosen. As a mere example, the second section 112 can be sized to carry a payload 210 therein. Thus, the case 110 of the thermal control system 100 can function as a transport device. The intermediate floor 150, in this case, can be configured to carry the payload 210 arranged in the second section 112. This may include the intermediate floor 150 is statically sufficiently strong to carry the payload 210, to have holding points or securing the payload 210, etc.

The intermediate floor 150 comprises a phase-change material. Furthermore, the intermediate floor 150 is configured to allow air to passage through the intermediate floor 150 and to exchange heat with the phase-change material. Thus, the air can change its temperature depending on the phase-change material. As a mere example, the first section 111 may contain air of a first temperature $T_0$, which may correspond to a temperature of the air in the exterior environment of the case 110. When the air streams through the intermediate floor 150, the air can take up heat energy from the phase-change material, i.e., the air stream is warmed or heated to a temperature $T_1$ when streaming towards the second section 112 ($T_0<T_1$).

The thermal control system 100 comprises a first air passage 120 arranged in the case 110 and fluidly connecting the first section 111 with the exterior environment of the case 110. For example, the first air passage 120 can be configured to allow air from the exterior environment to enter into the first section 111 and likewise to allow air to leave the first section 111 and stream into the exterior environment. Thus, a pressure equalization of the interior space of the case 110 can be achieved through the first air passage 120.

It is to be understood that the case 110 may be open with respect to the first section 111, so that the first air passage 120 in the case 110 is actually not necessary. However, if the case 110 includes an insulating material, the phase-change material of the intermediate floor 150 can be protected from the cooler exterior environment, i.e., loosing heat energy from the intermediate floor 150 can be hindered or avoided.

Figure 3:
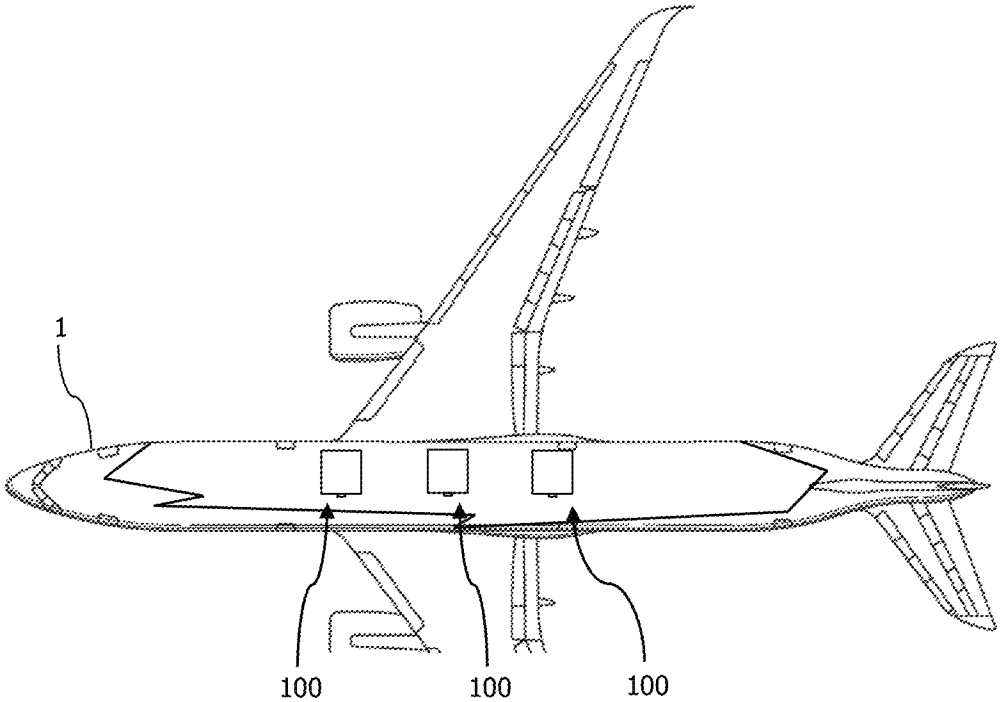
FIG. 3 schematically illustrates an aircraft having a plurality of thermal control systems.

FIG. 3 illustrates an aircraft 1 being equipped with several thermal control systems 100. This is to be understood as a mere example of using the thermal control system 100. The exterior environment of the case 110 then corresponds to the interior area of the aircraft 1. During ascending of the aircraft 1 the pressure in the interior area of the aircraft 1 decreases. A pressure equalization between the interior area of the aircraft 1 and the interior space of the case 110 can be achieved through the first air passage 120.

When reaching a high altitude, the air temperature inside of the aircraft 1 can become very low (corresponding to the ambient air outside of the aircraft 1, such as minus 30° C. or even below minus 50° C.). At this time, the case 110 can provide enough insulation for the payload 210 to not cool down or to cool down at an acceptable rate, such as 1 to 3K (Kelvin) per hour, or 2K per hour.

When the aircraft 1 descends, pressure equalization between the interior area of the aircraft 1 and the interior space of the case 110 will take place (recompression of the interior space takes occurs). This, however, means that the cold air from inside of the aircraft 1 reaches the payload 210, which may harm the payload 210 (e.g., due to condensation, freezing or otherwise cooling parts of the payload 210).

Since the air is forced to stream through the intermediate floor 150 during recompression, the air stream exchanges heat energy with the phase-change material in the intermediate floor 150. As a mere example, the phase-change material may become solid (freeze) due to the cold air stream. The air stream when reaching the second section 112 of the case 110 can have the phase-change temperature of the phase-change material. It is to be understood that the temperature of the air stream when reaching the second section 112 can be slightly below the phase-change temperature, e.g., by 0.5, 1 or 2K (Kelvin).

When choosing the phase-change material for a planned application (i.e., the desired minimum temperature for the payload 210), the material can be chosen in accordance with its phase-change temperature. For example, in order to reach room temperature in the second section 112 storing the payload 210, a phase-change material, such as a paraffin or salt hydrate, having a phase-change temperature of approximately 22° can be employed in the intermediate floor 150.

As can be derived from this particular example, any phase-change material can be employed, depending on the temperature to be achieved and/or the payload to be transported. The intermediate floor 150 can be equipped with a port 155 that is configured to release the phase-change material from the intermediate floor 150 and/or to fill the phase-change material into the intermediate floor 150. Thus, the phase-change material can be replaced by another one in correspondence to the circumstances for transporting the payload 210. This may further include providing a particular mass of phase-change material depending on the heat energy to be transferred to the airstream and/or depending on the amount of air streaming through the intermediate floor 150. The latter can, for example, further depend on the size of the second section 112 and/or the size of the payload 210. In any case, the intermediate floor 150 includes an interior empty space, that can be filled with the phase-change material.

Furthermore, the intermediate floor 150 can be configured to allow the air to pass therethrough with a velocity of flow between 0.5 m/s and 2.0 m/s, preferably between 0.7 m/s and 1.5 m/s. The particular velocity of flow can be achieved by a number and/or size of openings and/or channels through the intermediate floor 150. The velocity of flow can alternatively or additionally be achieved by baffles (not illustrated) or similar structures outside of the intermediate floor or in the openings and/or channels slowing down the air stream.

It is further to be noted that the length of a path through the intermediate floor 150 may be designed for a particular heating use case. On the one hand, the intermediate floor 150 may have a particular height, so that a through hole through the intermediate floor 150 has the required length for sufficient heat exchange between the air stream and the phase-change material. On the other hand, a channel through the intermediate floor 150 may be corrugated or meandering from the first section 111 to the second section 112, in order to be longer than a straight through hole through the intermediate floor 150.

Likewise, the intermediate floor 150 may only have a section provided with through holes and/or channels, while the remaining intermediate floor 150 is airtight or can be made airtight by closing the holes and lift channels, e.g., by covering the holes and/or channels. The size of the section defines the area, where an airstream is possible, which further defines the amount of air (mass/volume flow rate) that can pass from the first section 111 to the second section 112.

Furthermore, the thermal control system can comprise a second air passage 125 arranged in the case 110 and fluidly connecting the second section 112 with the exterior environment of the case 110. The second air passage 125 can be configured to allow air to leave the second section 112 into the exterior environment. The second air passage 125 can further be configured to hinder or block air from entering the second section 112 from the exterior environment. Such second air passage 125, hence, can be employed for pressure equalization between the second section 112 and the exterior environment, while avoiding air to stream through the intermediate floor 150 during the pressure equalization (pressure release).

Moreover, the case 110 can be configured to releasably hold the intermediate floor 150, so that the intermediate floor 150 can be replaced. As a mere example, a door or flap (not illustrated) can be arranged in the case 110, through which the intermediate floor 150 can be reached and taken out of the interior space of the case 110, and an intermediate floor 150 can be inserted into the interior space of the case 110. Thus, a heated intermediate floor 150 can be placed into the case 110, when it is needed, such as shortly before loading the payload 210.

Likewise, an intermediate floor 150 particularly designed for a payload 210 can be installed. Such particularly designed intermediate floor 150 may hold a specific phase-change material of a specific mass, may have a certain size (particularly thickness), may have a certain number and/or size of through holes and/or channels for the air stream between the first and second sections 111, 112, etc.

Figure 2:
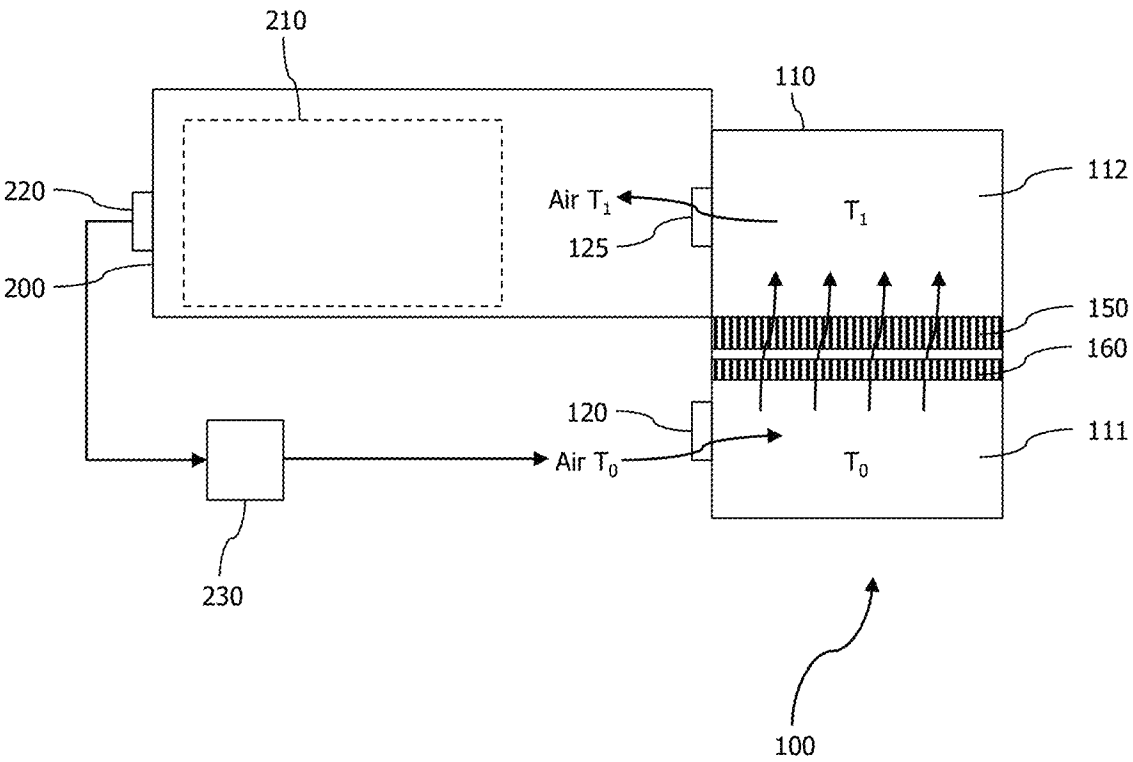
FIG. 2 schematically illustrates an exemplary transport system including a thermal control system.

FIG. 2 schematically illustrates a transport system having a thermal control system 100. The thermal control system 100 can be the one illustrated and described with respect to FIG. 1. Likewise, the thermal control system 100 of FIG. 1 can have features that are only illustrated in FIG. 2. Thus, both thermal control systems 100 are interchangeable.

The transport system comprises a transport container 200 configured to hold a payload 210. This allows carrying the payload 210 with the container 200. In addition, the transport container 200 can be insulated, so that the payload 210 may not cool down when being transported in a cold environment. The transport container 200 can be a specific container for the payload 210 or can be a standardized container, such as air cargo containers or overseas containers.

In the example illustrated in FIG. 2, the interior space of the transport container 200 can be fluidly connected with the second section 112 of the thermal control system 100, for example via the second air passage 125. Although FIG. 2 illustrates the transport container 200 abutting the case 110, the transport container 200 can be spaced apart from the case 110 and an (insulated) air duct can be provided between the second air passage 125 and the interior space of the transport container 200.

In this exemplary transport system, the principle of avoiding cold air hitting the payload 210 corresponds to the one explained with respect to FIG. 1. For example, if the transport container 200 is placed in an aircraft 1, a pressure equalization may take place between the interior area of the aircraft 1 and the interior space of the transport container 200. Thus, air can escape from the transport container 200 during ascending of the aircraft 1, while cold air may be drawn into the transport container 200 during descending of the aircraft 1.

The escaping of air from the transport container 200 may be facilitated by an air release passage 220 that is configured to allow air to leave the interior space of the transport container 200 into the exterior environment, but hinder or block air from entering the transport container 200.

Thus, in order to allow pressure equalization, air from the interior area of the aircraft 1 has to pass through the first section 111, the intermediate floor 150, the second section 112 and the second air passage 125. The air in the interior area of the aircraft 1 can have a temperature $T_0$, which is too low (too cold) for the payload 210. While streaming through the intermediate floor 150, the air can be heated (up to temperature $T_1$, which can be optimized for the payload 210). Thus, cold air hitting the payload 210 can be avoided by simple passive components.

As a mere example, if the transport container 200 has the size of a (standardized, usual) aircraft cargo container, the intermediate floor 150 can have width between 0.5 m and 1.5 m, preferably between 1.0 m and 1.5 m, and can have a length between 0.5 m and 1.5 m, preferably between 0.8 m and 1.2 m (wherein the width and length are the dimensions corresponding to the dimensions illustrated in the lower drawing of FIG. 1). The thickness of the intermediate floor 150 (dimension corresponding to the height in the upper right drawing of FIG. 1) can depend on the mass of phase-change material to be stored and/or needed in the intermediate floor 150. For example, the thickness of the intermediate floor 150 can be between 5 cm and 60 cm, and, preferably, can be between 10 cm to 50 cm. As a mere example, an exemplary intermediate floor 150 can have an area (width×length) of 2 $m^2$ with a thickness of about 11 cm.

It is to be understood, that the intermediate floor 150 can have any dimension required and placeable in the case 110. For example, the first and second sections 111, 112 can be much smaller than illustrated in FIGS. 1 and 2, since no payload 210 is to be stored. In other words, the case 110 can be almost the same size as the intermediate floor 150, so that any dimension, particularly the thickness, of the intermediate floor 150 can be optimized for the amount of warmed air to be provided to the transport container 200.

According to another example, the thermal control system 100 can comprise a heating element 160 configured to heat air in the first section 111 and/or to heat the phase-change material in the intermediate floor 150. It is to be understood that such heating element 160 can likewise be employed in the exemplary thermal control system 100 of FIG. 1. The heating element 160 can be an electric heating element. Alternatively or additionally, the heating element 160 can be heated by gas or hot air or the like. As a mere example, the heating element 160 can be a heating fan, i.e., an era conveying devices heating the conveyed air. Alternatively, the heating element 160 can be implemented as one or more channels arranged besides or in the intermediate floor 150, through which a heated fluid flows, such as a hot gas or liquid, for example, from an aircraft component or device providing waste heat.

The heating of the phase-change material may become necessary, if the transport under very cold conditions is long. For instance, an insulated case 110 may not be sufficient to maintain the temperature of the phase-change material in the intermediate floor 150 for the complete duration of the transportation. As the aircraft-descending issue (recompression of the transport container 200) will occur at the end of the transportation time, the phase-change material may have cooled down too much. In this case, the heating element 160 may be configured to maintain the temperature of the phase-change material, particularly to maintain a fluid state of the phase-change material.

Furthermore, the heating element 160 can also be used to "reload" the phase-change material. For instance, in a time between transports, the phase-change material can be heated again. This can be achieved by providing power to the thermal control system 100 (e.g., by a ground unit at an airport). Furthermore, a fast heating of the phase-change material using the heating element 160 can be achieved outside of the aircraft, while only a low power is applied to the heating element 160 during flight. This increases security, since the power supplied by the heating element 160 does not need to heat the air streaming into the transport container 200 (during descending of the aircraft 1). It is sufficient to maintain the temperature of the phase-change material, since the phase-change material will provide its stored heat energy during descending of the aircraft 1. The insulation of the case 110 and the transport container 200 can guarantee a rather low energy loss.

On the other hand, the heating element 160 can likewise be used to maintain a particular temperature of the payload 210 and/or in the interior space of the transport container 200. For example, as illustrated in FIG. 2, an optional air conveying device 230 can be provided that is configured to convey air from the interior space of the transport container 200 to the first section 111 of the thermal control system 100. As a mere example, the air conveying device 230 can receive air through the air release passage 220 and guide it to the first section 111. The air conveying device 230, for example, can convey the air through the first air passage 120 into the first section 111. Thus, the air stream generated by the air conveying device 230 can be heated by the heating element 160 (for instance, if it is arranged in the first section 111) before entering the interior space of the transport container 200 through the second section 112 and the second air passage 125.

This air cycle generated by the air conveying device 230 can likewise be performed without the heating element 160. In this case, the air temperature may be maintained (the air may be heated) by the phase-change material in the intermediate floor 150. In this case, the mass of the phase-change material should be selected large enough for the entire duration of the heating cycle.

It is to be understood that, although the present disclosure refers to a phase change from liquid to solid and vice versa, a phase change of the phase-change material from gaseous to liquid and vice versa may also be employed.

Figure 4:
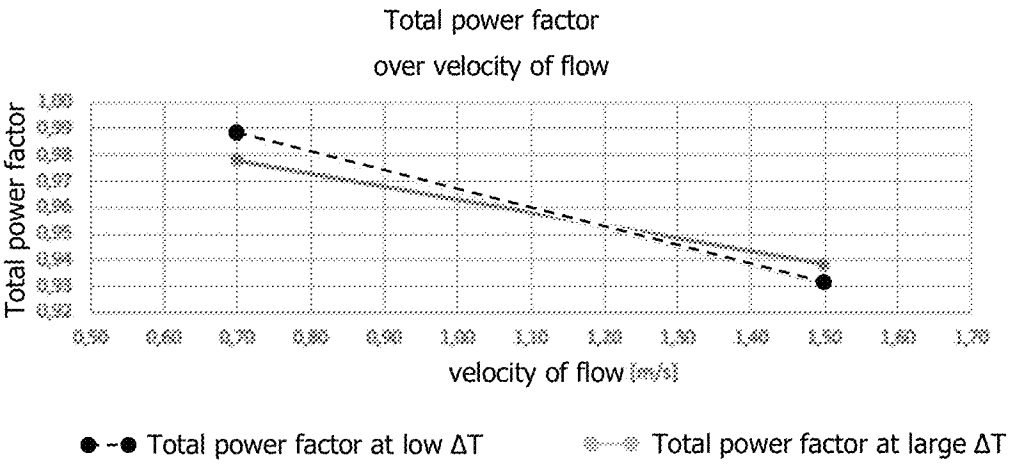
FIG. 4 schematically illustrates the relationship between total power factor and velocity of flow through a phase-change material.

FIG. 4 schematically illustrates the relationship between a total power factor and a velocity of flow of air through a phase-change material. In other words, FIG. 4 illustrates a diagram showing the relationship of the velocity of flow of air flowing through the intermediate floor 150 and the total power factor representing the heat energy exchange between phase-change material and air stream. The total power factor, for example, can be derived as $$\theta = \frac{T_1 - T_0}{T_{PCM} - T_0}$$

wherein θ is the total power factor, To is the air temperature at the first air passage 120, $T_1$ is the air temperature leaving the intermediate floor 150, and $T_{PCM}$ is the phase-change temperature of the phase-change material, such as the crystallization temperature of the phase-change material.

If the total power factor θ equals 1 (θ=1), the temperature $T_1$ in the second section 112 equals the phase-change temperature $T_{PCM}$. Such balance can be achieved at a slow velocity of flow of the air stream.

As can be derived from FIG. 4, the higher the velocity of flow, the less is the total power factor. This is due to the decreasing of heat exchange time, i.e., the time the air stream is in thermal contact with the intermediate floor 150, i.e. the time of the air being in thermal contact with the phase-change material.

It is believed that the advantages of the technique presented herein will be fully understood from the foregoing description, and it will be apparent that various changes may be made in the form, constructions and arrangement of the exemplary aspects thereof without departing from the scope of the disclosure or without sacrificing all of its advantageous effects. Because the technique presented herein can be varied in many ways, it will be recognized that the disclosure should be limited only by the scope of the claims that follow.

The systems and devices described herein may include a controller or a computing device comprising a processing and a memory which has stored therein computer-executable instructions for implementing the processes described herein. The processing unit may comprise any suitable devices configured to cause a series of steps to be performed so as to implement the method such that instructions, when executed by the computing device or other programmable apparatus, may cause the functions/acts/steps specified in the methods described herein to be executed. The processing unit may comprise, for example, any type of general-purpose microprocessor or microcontroller, a digital signal processing (DSP) processor, a central processing unit (CPU), an integrated circuit, a field programmable gate array (FPGA), a reconfigurable processor, other suitably programmed or programmable logic circuits, or any combination thereof.

The memory may be any suitable known or other machine-readable storage medium. The memory may comprise non-transitory computer readable storage medium such as, for example, but not limited to, an electronic, magnetic, optical, electromagnetic, infrared, or semiconductor system, apparatus, or device, or any suitable combination of the foregoing. The memory may include a suitable combination of any type of computer memory that is located either internally or externally to the device such as, for example, random-access memory (RAM), read-only memory (ROM), compact disc read-only memory (CDROM), electro-optical memory, magneto-optical memory, erasable programmable read-only memory (EPROM), and electrically-erasable programmable read-only memory (EEPROM), Ferroelectric RAM (FRAM) or the like. The memory may comprise any storage means (e.g., devices) suitable for retrievably storing the computer-executable instructions executable by processing unit.

The methods and systems described herein may be implemented in a high-level procedural or object-oriented programming or scripting language, or a combination thereof, to communicate with or assist in the operation of the controller or computing device. Alternatively, the methods and systems described herein may be implemented in assembly or machine language. The language may be a compiled or interpreted language. Program code for implementing the methods and systems described herein may be stored on the storage media or the device, for example a ROM, a magnetic disk, an optical disc, a flash drive, or any other suitable storage media or device. The program code may be readable by a general or special-purpose programmable computer for configuring and operating the computer when the storage media or device is read by the computer to perform the procedures described herein.

Computer-executable instructions may be in many forms, including modules, executed by one or more computers or other devices. Generally, modules include routines, programs, objects, components, data structures, etc., that perform particular tasks or implement particular abstract data types. Typically, the functionality of the modules may be combined or distributed as desired in various embodiments.

It will be appreciated that the systems and devices and components thereof may utilize communication through any of various network protocols such as TCP/IP, Ethernet, FTP, HTTP and the like, and/or through various wireless communication technologies such as GSM, CDMA, Wi-Fi, and WiMAX, is and the various computing devices described herein may be configured to communicate using any of these network protocols or technologies.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. A thermal control system for transporting a payload, the thermal control system comprising:

a case;

an intermediate floor dividing an interior space of the case in a first section and a second section; and, a first air passage arranged in the case and fluidly connecting the first section with an exterior environment of the case, wherein the intermediate floor comprises a phase-change material and a plurality of at least one of channels, openings, and through holes which are each configured to allow air to passively pass through the phase-change material of the intermediate floor and thereby to exchange heat with the phase-change material without a ventilation device.

2. The thermal control system of claim 1, wherein the first air passage is configured to allow air from the exterior environment to enter into the first section.

3. The thermal control system of claim 1, further comprising:

a second air passage arranged in the case and fluidly connecting the second section with the exterior environment of the case, wherein the second air passage is configured to allow air to leave the second section into the exterior environment.

4. The thermal control system of claim 1, wherein the intermediate floor comprises a port configured to release the phase-change material from the intermediate floor, or to fill the phase-change material into the intermediate floor, or both, or wherein the case is configured to releasably hold the intermediate floor, so that the intermediate floor can be replaced, or both.

5. The thermal control system of claim 1, wherein the phase-change material has a phase-change temperature between −40° C. and +40° C.

6. The thermal control system of claim 1, wherein the phase-change material comprises a paraffin, a lipid, a sugar alcohol, or any combination thereof.

7. The thermal control system of claim 1, wherein the intermediate floor is configured to allow the air to pass therethrough with a velocity of flow between 0.5 m/s and 2.0 m/s.

8. The thermal control system of claim 1, further comprising:

a heating element configured to heat air in the first section, or to heat the phase-change material in the intermediate floor, or to heat both.

9. The thermal control system of claim 1, wherein the intermediate floor is configured to carry a payload arranged in the second section.

10. A transport system, comprising:

a transport container configured to hold a payload; and the thermal control system according to claim 1, wherein an interior space of the transport container is fluidly connected with the second section of the thermal control system.

11. The transport system of claim 10, further comprising:

an air release passage arranged in the transport container and fluidly connecting the interior space of the transport container with the exterior environment, wherein the air release passage is configured to allow air to leave the interior space of the transport container into the exterior environment.

12. The transport system of claim 10, further comprising:

an air conveying device configured to convey air from the interior space of the transport container to the first section of the thermal control system.

13. An aircraft comprising:

the thermal control system according to claim 1.

14. An aircraft comprising:

the transport system according to claim 10.

15. The thermal control system of claim 1, wherein at least one of the channels through the intermediate floor corrugates or meanders through the first section to the second section.

16. The thermal control system of claim 1, wherein each of the plurality of the at least one of channels, openings, and through holes are arranged perpendicularly with a face of the intermediate floor.

* * * * *